US006220926B1

(12) United States Patent
Mizuno

(10) Patent No.: US 6,220,926 B1
(45) **Date of Patent: *Apr. 24, 2001**

(54) EYEGLASS LENS GRINDING APPARATUS

(75) Inventor: Toshiaki Mizuno, Aichi (JP)

(73) Assignee: Nidek Co., Ltd., Aichi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/050,977

(22) Filed: Mar. 31, 1998

(30) Foreign Application Priority Data

Mar. 31, 1997 (JP) ..... 9-098220

(51) Int. Cl.[7] ..... B24B 49/00; B24B 51/00

(52) U.S. Cl. ..... 451/5; 451/8; 451/43; 451/255; 451/256

(58) Field of Search ..... 451/5, 8, 43, 240, 451/255, 256, 277; 33/28, 200, 507, 551, 553, 554, 555, 1 M

(56) References Cited

U.S. PATENT DOCUMENTS

| | | | | |
|---|---|---|---|---|
| 5,027,560 | * | 7/1991 | Coburn et al. | 51/124 |
| 5,138,770 | | 8/1992 | Matsuyama | 33/28 |
| 5,228,242 | | 7/1993 | Matsuyama | 51/165.74 |
| 5,333,412 | | 8/1994 | Matsuyama | 51/165.71 |
| 5,347,762 | | 9/1994 | Shibata et al. | 451/15 |
| 5,600,574 | * | 2/1997 | Reitan | 364/552 |
| 5,716,256 | * | 2/1998 | Mizuno et al. | 451/5 |
| 5,803,793 | * | 9/1998 | Mizuno et al. | 451/5 |
| 5,890,949 | * | 4/1999 | Shibata | 451/5 |

FOREIGN PATENT DOCUMENTS

| | | | |
|---|---|---|---|
| 576268 | 12/1993 | (EP) . | |
| 3-20603 | 1/1991 | (JP) | G01B/5/06 |
| 6-208092 | 7/1994 | (JP) . | |

* cited by examiner

*Primary Examiner*—Timothy V. Eley
(74) *Attorney, Agent, or Firm*—Sughrue, Mion, Zinn, Macpeak & Seas, PLLC

(57) ABSTRACT

An eyeglass lens is designed to permit the operator to preset by himself the conditions for bevel formation in AUTO mode so that he can perform efficient lens processing. The eyeglass lens grinding apparatus includes frame data inputting section for entering configuration data on an eyeglass frame, layout data inputting section for entering layout data to be used in providing a layout of an eyeglass lens to be processed which corresponds to the eyeglass frame, edge position detecting section for determining data on the edge position of the processed lens on the basis of the frame configuration data and the layout data. The lens grinding apparatus further includes an arithmetic control circuit, a parameter input section, and a sequence program stored in a main program memory. The sequence program allows a user to input or alter the parameters—even when the lens grinding apparatus operates in an auto-processing mode—used to calculate bevel processing data. Allowing a user to input or alter parameters, even in an auto-processing mode, enhances the utility of the lens grinding apparatus. Further, even after the bevel processing data has been calculated on the basis of a user input or altered parameter, the user can, in a forced-processing mode, further alter a portion of the bevel processing data calculated using an altered parameter in the auto-processing mode.

8 Claims, 8 Drawing Sheets

EYEGLASS LENS GRINDING APPARATUS

BACKGROUND OF THE INVENTION

The present invention relates to an eyeglass lens grinding apparatus for grinding the periphery of lenses to fit into an eyeglass frame.

An eyeglass lens grinding apparatus is known and it grinds the periphery of lenses to form a bevel at which each lens is supported in the groove of the eyeglass frame so as to achieve good fit into the latter.

In lens processing with this type of grinding apparatus, it is important to determine the best bevel position with respect to the edge position of a lens which has been processed into conformity with the configuration of an eyeglass frame. This is largely dependent on the experience and special hunch of the operator and great skill has been required to form satisfactory bevels. To deal with this problem, the edge position predestined by lens processing is measured and after the bevel position that divides the edge at a preset ratio is automatically determined on the basis of the obtained information, processing is subsequently carried out in accordance with the thus obtained information on the bevel position. An apparatus capable of this automated (AUTO) processing is already in commercial use.

However, the bevel position to be determined in the automated processing is entirely up to the manufacturer of the processing apparatus and the bevel formed is not necessarily in compliance with the specifications required by the processor (who has presented the eyeglasses). To accommodate this situation, the apparatus described above is adapted to be such that the processing mode is shifted to FORCED mode and the bevel position can be altered by supplying the apparatus with the necessary information. However, it is cumbersome to adjust the bevel position in each processing cycle.

In addition, the thickness of the rim of the eyeglass frame is generally different depending upon whether its constituent material is metallic or plastic and, it often becomes necessary to alter the bevel position in accordance with the constituent material of the frame.

SUMMARY OF THE INVENTION

The present invention has been accomplished under these circumstances and has as an object providing an eyeglass lens grinding apparatus which enables the processor to preset by himself the conditions of bevel formation in automated processing such as to permit for efficient lens processing.

Another object of the invention is to provide an eyeglass lens grinding apparatus which is capable of bevel formation as appropriate for the constituent material of the eyeglass frame into which the lens is to be fitted.

The stated objects of the invention can be attained by the following.

(1) An eyeglass lens grinding apparatus for grinding the periphery of a lens to fit into an eyeglass frame, comprising:

frame data inputting means for entering configuration data on said eyeglass frame;

layout data inputting means for entering layout data to be used in providing a layout of the lens corresponding to said eyeglass frame;

edge position detecting means for determining data on the edge position of the processed lens on the basis of said frame configuration data and said layout data;

bevel data calculating means which possesses calculation formula having at least one parameter and which calculators bevel data;

standard value storage means for storing a standard value of said parameter;

parameter altering means for altering the parameter from its standard value; and control means for automatically bevelling the lens on the basis of the bevel data calculated using the altered parameter.

(2) The eyeglass lens grinding apparatus recited in (1), wherein said parameter comprises either the ratio of dividing the edge thickness of the processed lens or the amount of offset or both.

(3) The eyeglass lens grinding apparatus recited in (2), which further includes frame material designating means and wherein said ratio or amount of offset varies with the constituent material of the eyeglass frame.

(4) The eyeglass lens grinding apparatus recited in (3), wherein the constituent material of the eyeglass frame is either metallic or plastic.

(5) The eyeglass lens grinding apparatus recited in (1), wherein said parameter is the ratio of dividing the edge thickness of the processed lens and the calculation formula possessed by said bevel data calculating means has the power of the lens as a variable.

(6) The eyeglass lens grinding apparatus recited in (1), which further includes curve calculating means for calculating the front and rear surface curves of the lens on the basis of the result of detection by said edge position detecting means, said parameter is the ratio of dividing the edge thickness of the processed lens and the calculating formula possessed by said bevel data calculating means has a variable based on the difference between the front and rear surface curves of the lens.

(7) An eyeglass lens grinding apparatus for grinding the periphery of a lens to fit into an eyeglass frame, comprising:

frame data inputting means for entering configuration data on said eyeglass frame;

layout data inputting means for entering layout data to be used in providing a layout of the lens corresponding to said eyeglass frame;

edge position detecting means for determining data on the edge position of a processed lens on the basis of the said frame configuration data and said layout data;

bevel data calculating means which possessed a calculating formula having at least one parameter and which calculates bevel data;

standard value storage means for storing a standard value of said parameter;

parameter altering means for altering the parameter from its standard value;

forced processing data inputting means for further altering the bevel data calculated using the altered parameter; and control means for bevelling the lens on the basis of second bevel data altered on the basis of the data entered by said forced processing data inputting means.

DETAILED DESCRIPTION OF THE PREFERRED EMBODIMENT

Figure 1:
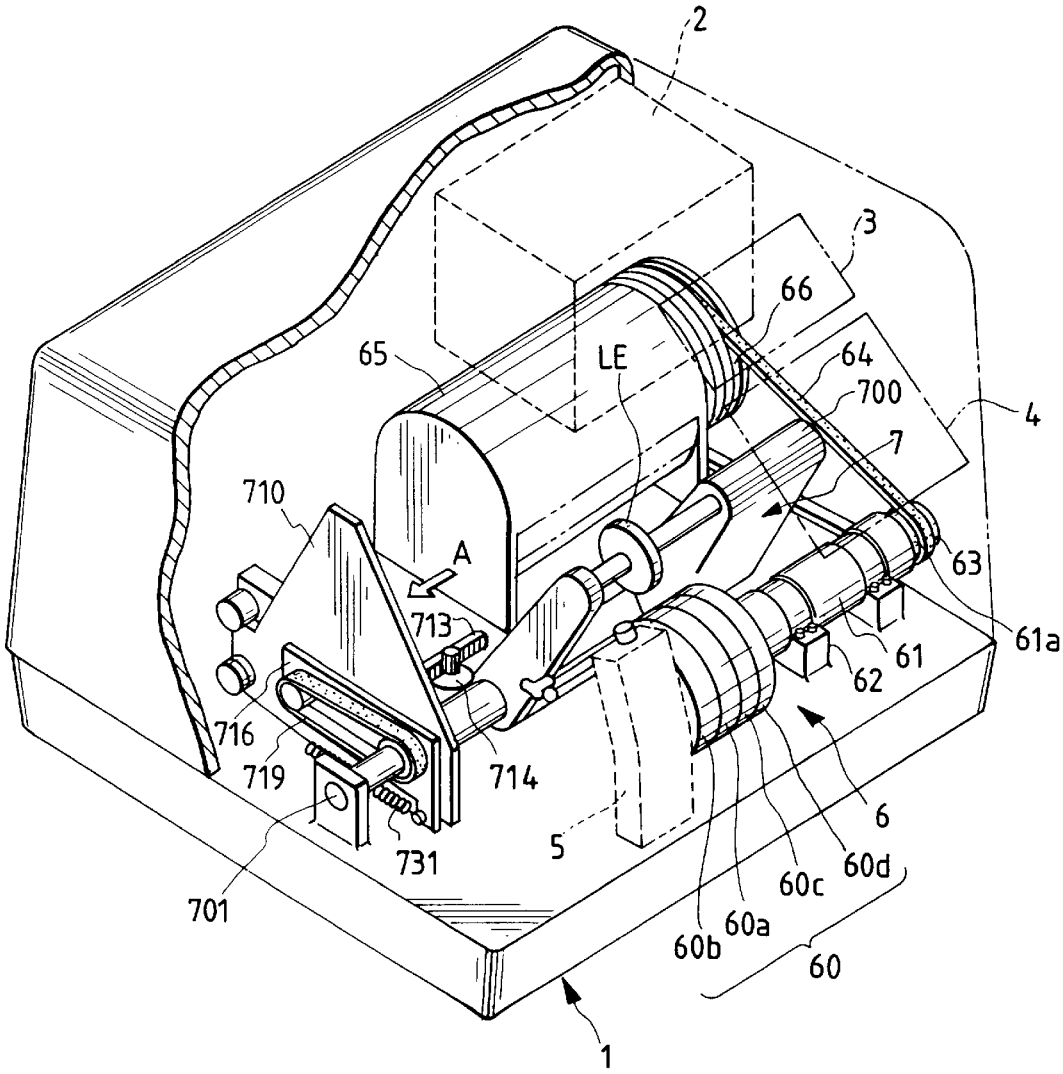
FIG. 1 is a perspective view showing the general layout of the eyeglass lens grinding machine of the invention.

An embodiment of the invention will now be described in detail with reference to the accompanying drawings. FIG. 1 is a perspective view showing the general layout of the eyeglass lens grinding machine of the invention. The reference numeral 1 designates a machine base, on which the components of the machine are arranged. The numeral 2 designates an eyeglass frame and template configuration measuring section, which is incorporated in the upper section of the grinding machine to obtain three-dimensional configuration data on the geometries of the eyeglass frame and the template. Arranged in front of the measuring section 2 are a display section 3 which displays the results of measurements, arithmetic operations, etc. in the form of either characters or graphics, and an input section 4 for entering data or feeding commands to the machine. Provided in the front section of the machine is a lens configuration measuring section 5 for measuring the geometry (edge thickness) of the lens to be processed.

The reference numeral 6 designates a lens grinding section, where an abrasive wheel group 60 made up of a rough abrasive wheel 60*a* for use on glass lenses, a rough abrasive wheel 60*b* for use on plastic lenses and a finishing abrasive wheel 60*c* for tapered edge (bevel) and plane processing operations is mounted on rotating shaft 61*a* through a spindle unit 61 fixed to the machine base 1. Shown by 65 is an AC motor for rotating the abrasive wheels and its rotation is transmitted to the abrasive wheel group 60 via a pulley 63 attached to the rotational shaft 61*a*, a belt 64 and a pulley 66. Shown by 7 is a carriage section and 700 is a carriage.

(Layout of the Major Components)

The layout of the major components of the grinding apparatus will now be described.

(A) Carriage section

Figure 2:
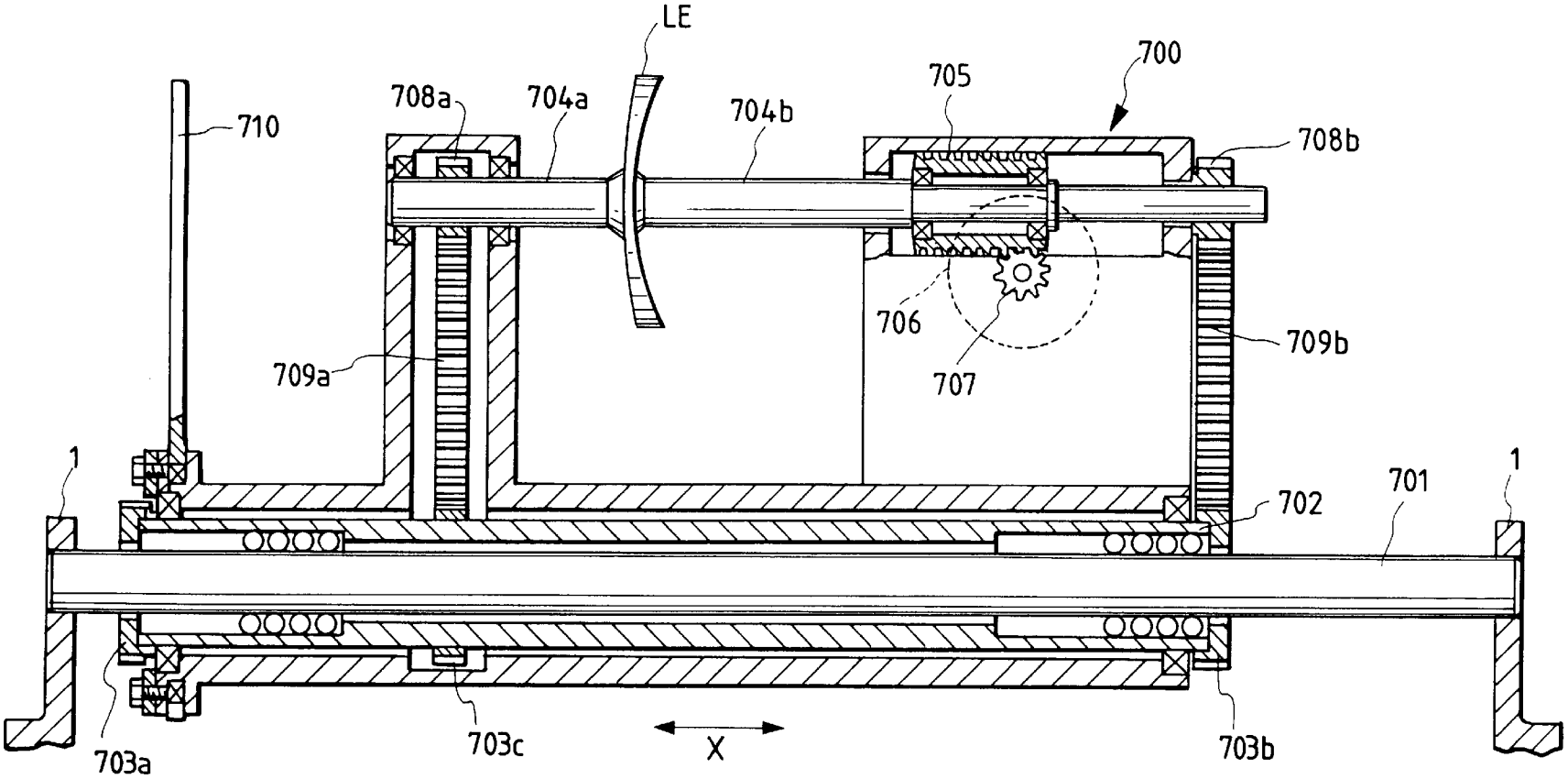
FIG. 2 is a cross-sectional view of a carriage.
Figure 3:
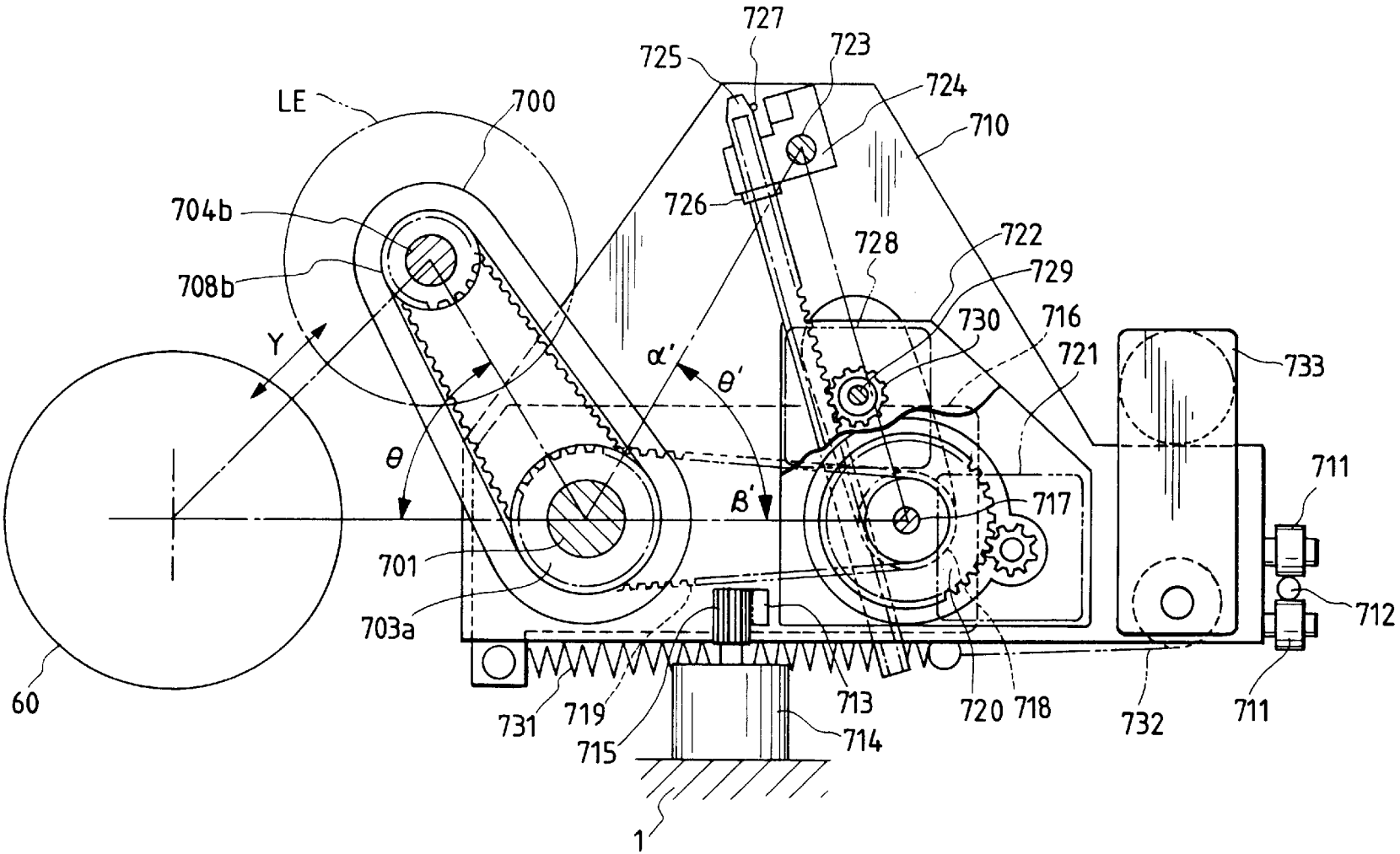
FIG. 3 is a diagram showing a carriage drive mechanism, as viewed in the direction of arrow A in FIG. 1.

The construction of the carriage section will now be described with reference to FIGS. 1 to 3. FIG. 2 is a cross-sectional view of the carriage, and FIG. 3 is a diagram showing a drive mechanism for the carriage, as viewed in the direction of arrow A in FIG. 1.

A shaft 701 is secured on the base 1 and a carriage shaft 702 is rotatably and slidably supported on the shaft 701; the carriage 700 is pivotally supported on the carriage shaft 702. Lens rotating shafts 704*a* and 704*b* are coaxially and rotatably supported on the carriage 700, extending parallel to the shaft 701. The lens rotating shaft 704*b* is rotatably supported in a rack 705, which is movable in the axial direction by means of a pinion 707 fixed on the rotational shaft of a motor 706; as a result, the lens rotating shaft 704*b* is moved axially such that it is opened or closed with respect to the other lens rotating shaft 704*a*, thereby holding the lens LE in position.

A drive plate 716 is securely fixed at the left end of the carriage 700 and a rotational shaft 717 is rotatably provided on the drive plate 716, extending parallel to the shaft 701. A pulse motor 721 is secured to the drive plate 716 by means of a block 722 and the rotation of the pulse motor 721 is transmitted to the shaft 702 via a gear 720 provided at the right end of the rotational shaft 717, a pulley 718 provided at the left end of the rotational shaft 717, a timing belt 719 and a-pulley 703*a*. The rotation of the shaft 702 in turn is transmitted to the lens rotating shafts 704*a* and 704*b* via timing belts 709*a* and 709*b*, pulleys 703*b*, 703*c*, 708*a* and 708*b*, whereupon the lens rotating shafts 704*a* and 704*b* are rotated in synchronism.

An intermediate plate 710 is rotatably secured at the left end of the carriage 700. The intermediate plate 710 has a rack 713 which meshes with a pinion 715 attached to the rotational shaft of a carriage moving motor 714. Rotating pinion 715 will cause the carriage 700 to move along the axis of the shaft 701.

The carriage 700 is allowed to pivot by a pulse motor 728, which is secured to a block 722 in such a way that a round rack 725 meshes with a pinion 730 secured to the rotational shaft 729 of the pulse motor 728. The round rack 725 extends parallel to the shortest line segment connecting the axis of the rotational shaft 717 and that of the shaft 723 secured to the intermediate plate 710; in addition, the round rack 725 is held to be slidable with a certain degree of freedom between a correction block 724 which is rotatably fixed on the shaft 723 and the block 722. A stopper 726 is fixed on the round rack 725 so that it is capable of sliding only downward from the position of contact with the correction block 724. With this arrangement, the axis-to-axis distance r' between the rotational shaft 717 and the shaft 723 can be controlled in accordance with the rotation of the pulse motor 728 and it is also possible to control the axis-to-axis distance r between the abrasive wheel rotating shaft 61*a* and each of the lens rotating shafts 704*a* and 704*b* since r has a linear correlationship with r'.

The layout of the carriage section is basically the same as what is described in commonly assigned U.S. Pat. No. 5,347,762, to which reference should be made for further details.

(B) Eyeglass Frame and Template Configuration Measuring Section

Figure 4:
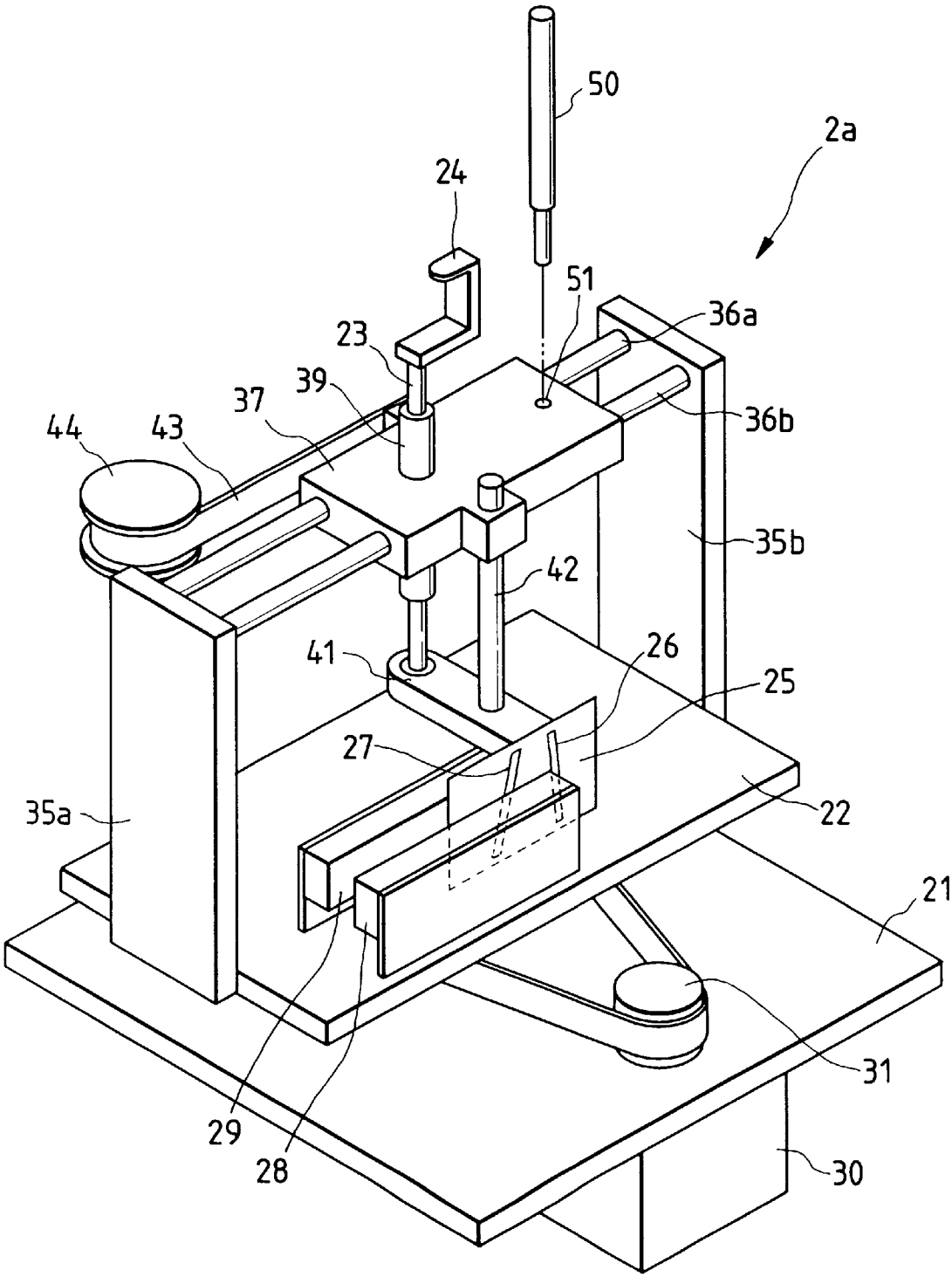
FIG. 4 is a perspective view of the functional part of an eyeglass frame and template configuration measuring section.

FIG. 4 is a perspective view of the functional part 2*a* of the eyeglass frame and template configuration measuring section 2. The functional part 2*a* comprises a moving base 21 which is movable in a horizontal direction, a rotating base 22 which is rotatably and axially supported on the moving base 21 and which is rotated by a pulse motor 30, a moving block 37 which is movable along two rails 36*a* and 36*b* supported on retainer plates 35*a* and 35*b* provided vertically on the rotating base 22, a gage head shaft 23 which is passed through the moving block 37 in such a way that it is capable of both rotation and vertical movements, a gage head 24 attached to the top end of the gage head shaft 23 such that its distal end is located on the central axis of the shaft 23, an arm 41 which is rotatably attached to the bottom end of the shaft 23 and is fixed to a pin 42 which extends from the moving block 37 vertically, a light shielding plate 25 which is attached to the distal end of the arm 41 and which has a vertical slit 26 and a 45° inclined slit 27 formed therein, a combination of a light-emitting diode 28 and a linear image sensor 29 which are attached to the rotating base 22 to interpose the light shielding plate 25 therebetween, and a constant-torque spring 43 which is attached to a drum 44 rotationally and axially supported on the rotating base 22 and which normally pulls the moving block 37 toward the distal end of the head gage 24.

The moving block 37 also has a mounting hole 51 through which a measuring pin 50 is to be inserted for measurement of the template.

The functional part 2*a* having the construction just described above measures the configuration of the eyeglass frame in the following manner. First, the eyeglass frame is fixed in a frame holding portion (not shown but see, for example, U.S. Pat. No. 5,347,762) and the distal end of the gage head 24 is brought into contact with the bottom of the groove formed in the inner surface of the eyeglass frame. Subsequently, the pulse motor 30 is allowed to rotate in response to a predetermined unit number of rotation pulses. As a result, the gage head shaft 23 which is integral with the gage head 24 moves along the rails 36*a* and 36*b* in accordance with the radius vector of the frame and also moves vertically in accordance with the curved profiles of the frame. In response to these movements of the gage head shaft 23, the light shielding plate 25 moves both vertically and horizontally between the LED 28 and the linear image sensor 29 such as to block the light from the LED 28. The light passing through the slits 26 and 27 in the light shielding plate 25 reaches the light-receiving part of the linear image sensor 29 and the amount of movement of the light shielding plate 25 is read. Briefly, the position of slit 26 is read as the radius vector r of the eyeglass frame and the positional difference between the slits 26 and 27 is read as the height information z of the same frame. By performing this measurement at N points, the configuration of the eyeglass frame is analyzed as (rn, θn, zn) (n=1, 2, . . . , N). The eyeglass frame and template configuration measuring section 2 under consideration is basically the same as what is described in commonly assigned U.S. Pat. No. 5,138,770, to which reference should be made.

For measuring a template, the template is fixed on a template holding portion (see, for example, U.S. Pat. No. 5,347,762) and, the measuring pin 50 is fitted in the mounting hole 51. As in the case of measurement of the eyeglass frame configuration, the pin 50 will move along the rails 36*a* and 36*b* in accordance with the radius vector of the template and, hence, the position of slit 26 detected by the linear image sensor 29 is measured as information radius vector.

(C) Lens Configuration Measuring Section

Figure 5:
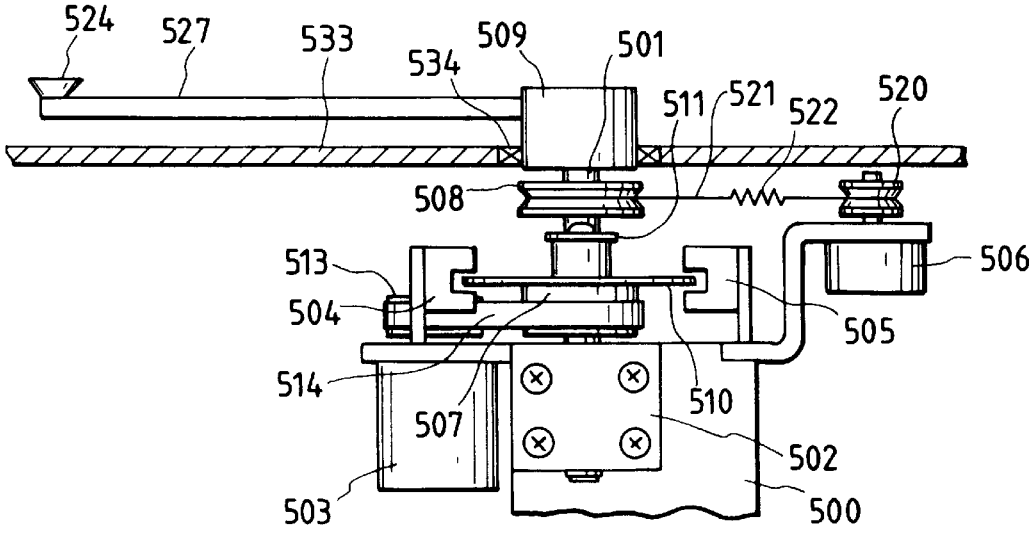
FIG. 5 is a sectional view of a lens configuration measuring section.
Figure 6:
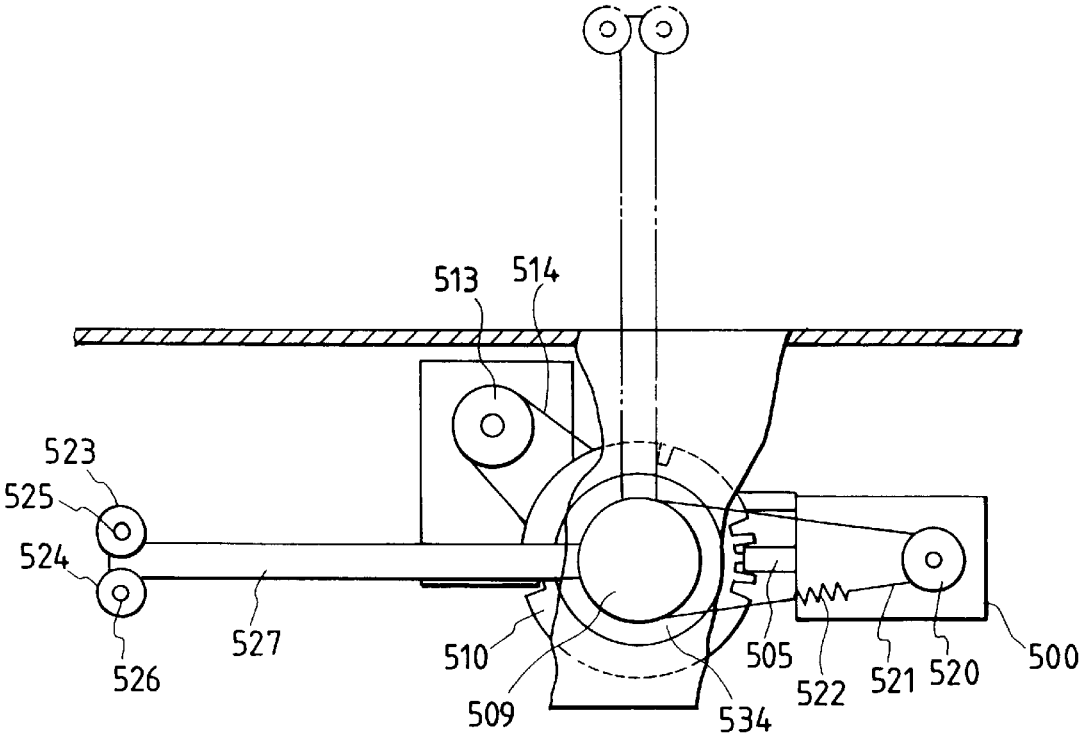
FIG. 6 is a plan view of the lens configuration measuring section.

FIG. 5 is a sectional view of the lens configuration measuring section 5 and FIG. 6 is a plan view of the same. The basic components of the lens configuration measuring section 5 are a measurement arm 527 having two feelers 523 and 524, a rotating mechanism comprising a DC motor 503 for rotating the measurement arm 527, a pulley 513, a belt 514, a pulley 507, a shaft 501 and a pulley 508 and so forth, as well as a detection mechanism comprising a sensor plate 510 and photoswitches 504 and 505 which detect the rotation of the measurement arm 527 to control the rotation of the DC motor 503, a potentiometer 506 which detects the amount of rotation of the measurement arm 527 to provide data on the geometries of the front and rear surfaces of the lens, and so forth. The layout of the lens configuration measuring section 5 is basically the same as what is descried in commonly assigned Unexamined Published Japanese Patent Application No. Hei 3-20603 and so forth, to which reference should be made for further details.

In the process of measuring the lens profile (edge thickness), the lens to be processed is revolved with the feeler 523 contacting the front refractive surface of the lens, whereby the potentiometer 506 detects the amount of rotation of the pulley 508 to provide data on the geometry of the front refractive surface of the lens; thereafter, the feeler 524 is brought into contact with the rear refractive surface of the lens and the same procedure is repeated to provide data on the geometry of the rear refractive surface of the lens.

(D) Display Section and Input Section

Figure 7:
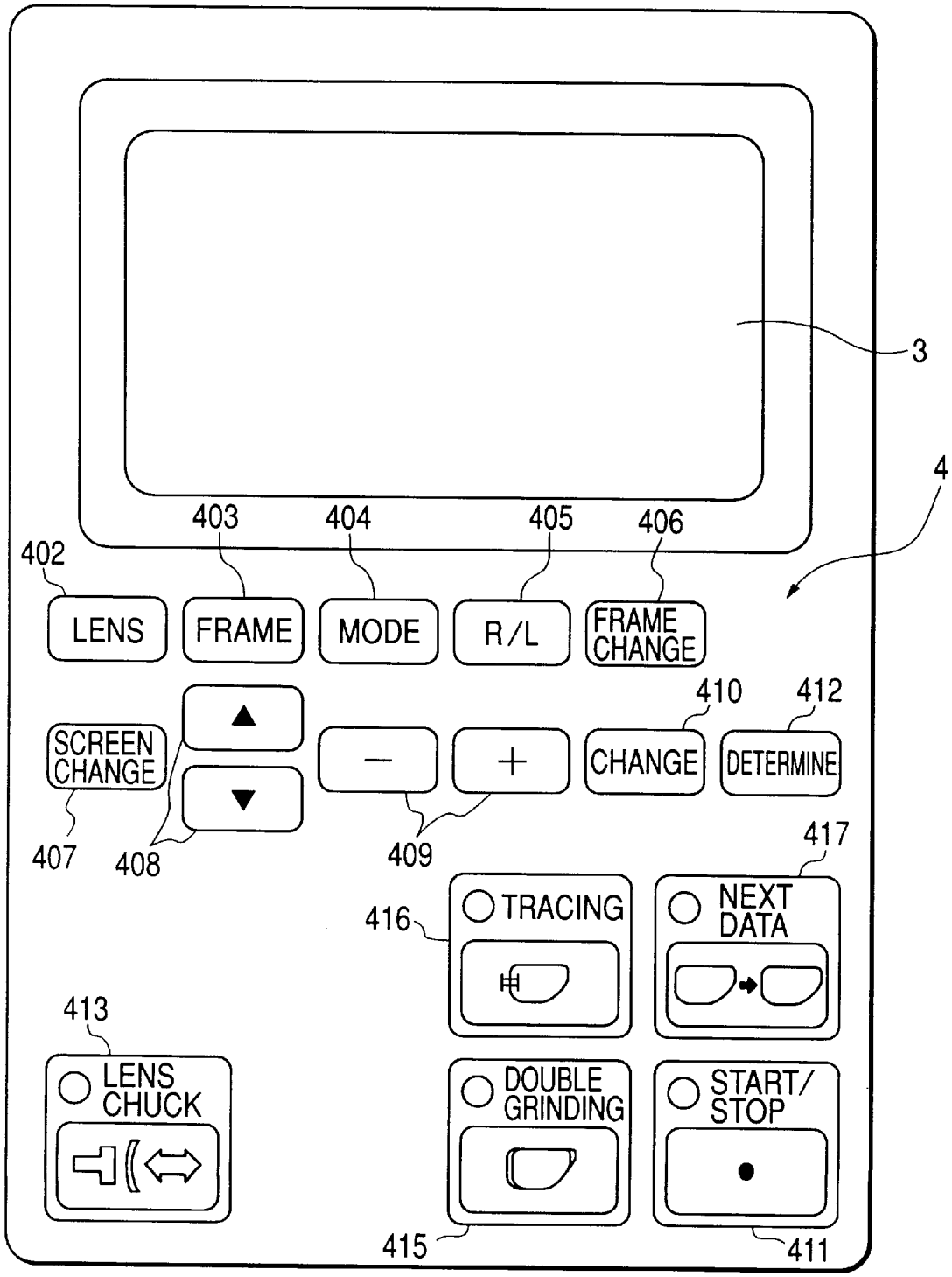
FIG. 7 is a diagram showing the outer appearance of a display section and an input section.

FIG. 7 is a diagram showing the outer appearance of the display section 3 and the input section 4. The display section 3 is formed of a liquid-crystal display and, under the control of a main arithmetic control circuit to be described later, it displays various images such as a parameter setting image, a layout image on which layout information can be entered and an image that simulates the bevel position relative to the lens geometry and the state of bevel cross section.

The input section 4 includes various setting switches such as a switch 402 for designating the constituent material of the lens to be processed, a switch 403 for designating the constituent material (metallic or plastic) of the frame, a mode switch 404 for selecting the mode of lens processing [whether it is automated bevel processing, forced bevel processing, plane processing or plane-specular processing (polishing)], a R/L switch 405 for determining whether the lens to be processed is for use on the right eye or the left eye, a switch 407 for changing the image to be displayed on the display section 3 (between a layout image, a menu image and a parameter setting image), a MOVE switch 408 for selecting an appropriate input item by moving the cursor or arrow that are displayed on the display section 3, a "+" switch 409*a* and "−" switch 409*b* for entering numerical data, a switch 410 for use on such occasions as the change of the format in which the layout data are to be entered, a START/STOP switch 411 for starting or stopping the lens processing operation, a switch 413 for opening or closing the lens chucks, a tracing switch 416 for giving directions on the lens frame or template tracing, a next-data switch 417 for transferring the data from the tracing operation, and so forth.

(E) Electronic Control System for the Machine

Figure 8:
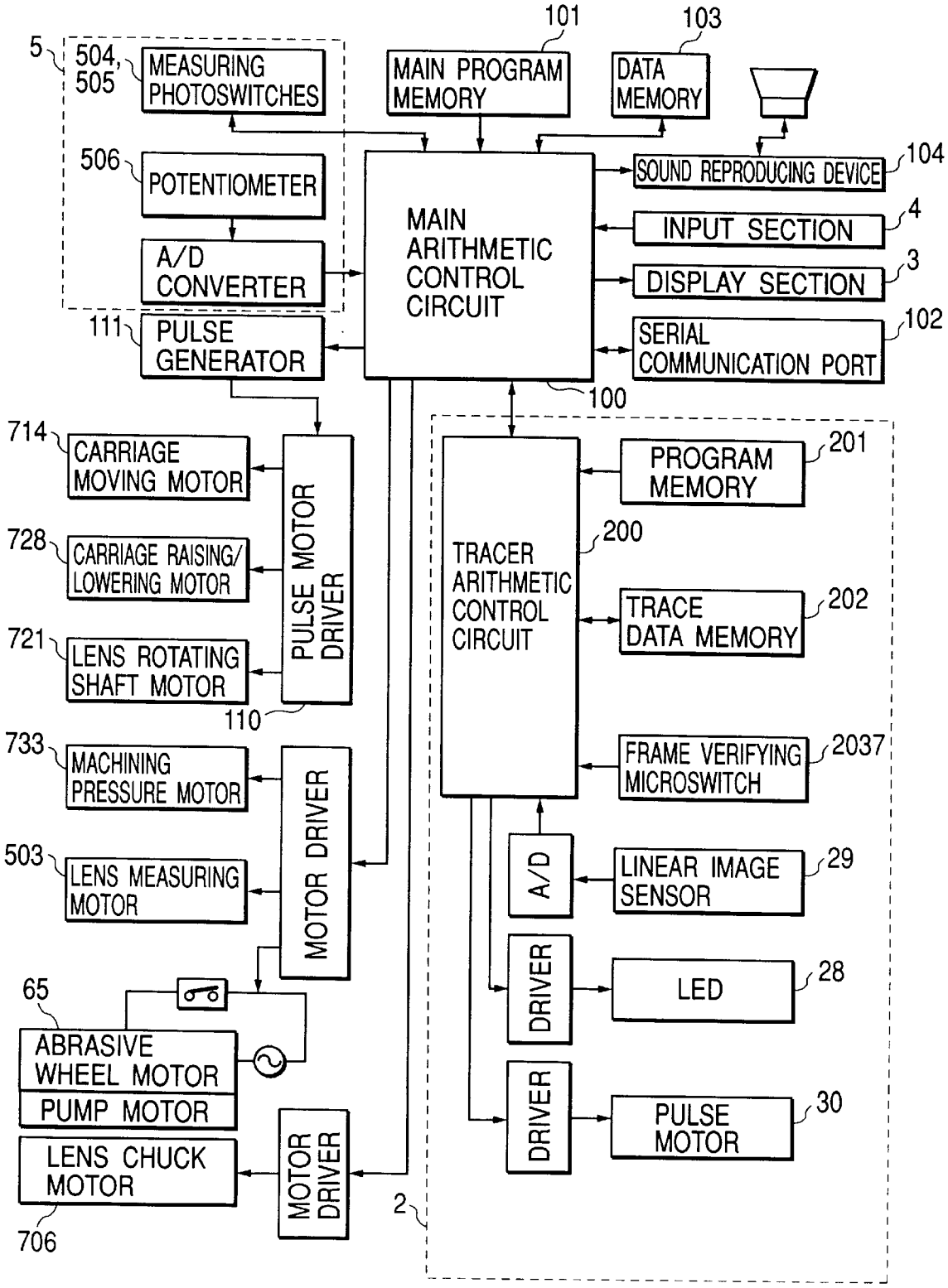
FIG. 8 is a diagram showing the essential part of a block diagram of the electronic control system for the eyeglass lens grinding machine of the invention.

FIG. 8 shows the essential part of a block diagram of the electronic control system for the eyeglass lens grinding machine of the invention. A main arithmetic control circuit 100 which is typically formed of a microprocessor and controlled by a sequence program stored in a main program memory 101. The main arithmetic control circuit 100 can exchange data with IC cards, eye examination devices and so forth via a serial communication port 102. The main arithmetic control circuit 100 also performs data exchange and communication with a tracer arithmetic control circuit 200 of the eyeglass frame and template configuration measurement section 2. Data on the eyeglass frame configuration are stored in a data memory 103.

The display section 3, the input section 4, a sound reproducing device 104 and the lens configuration measuring section 5 are connected to the main arithmetic control circuit 100. The measured data of lens which have been obtained by arithmetic operations in the main arithmetic control circuit 100 are stored in the data memory 103. The carriage moving motor 714, as well as the pulse motors 728 and 721 are connected to the main operation arithmetic circuit 100 via a pulse motor driver 110 and a pulse generator 111. The pulse generator 111 receives commands from the main operation arithmetic circuit 100 and determines how many pulses are to be supplied at what frequency in Hz to the respective pulse motors to control their operation.

The operation of the eyeglass lens grinding machine having the above-described construction will now be explained.

There are two modes of forming a bevel on the edge of a lens; one is an auto-processing mode in which bevel calculations are performed by computing formulae based on preliminarily machine-loaded parameters so as to accomplish automatic bevelling, and the other is a forced processing mode in which each time lens-processing is effected, the operator changes the bevelling data used in the auto-processing mode and performs the processing of the lens. On the pages that follow, processing in an auto mode is mainly described.

Figure 9:
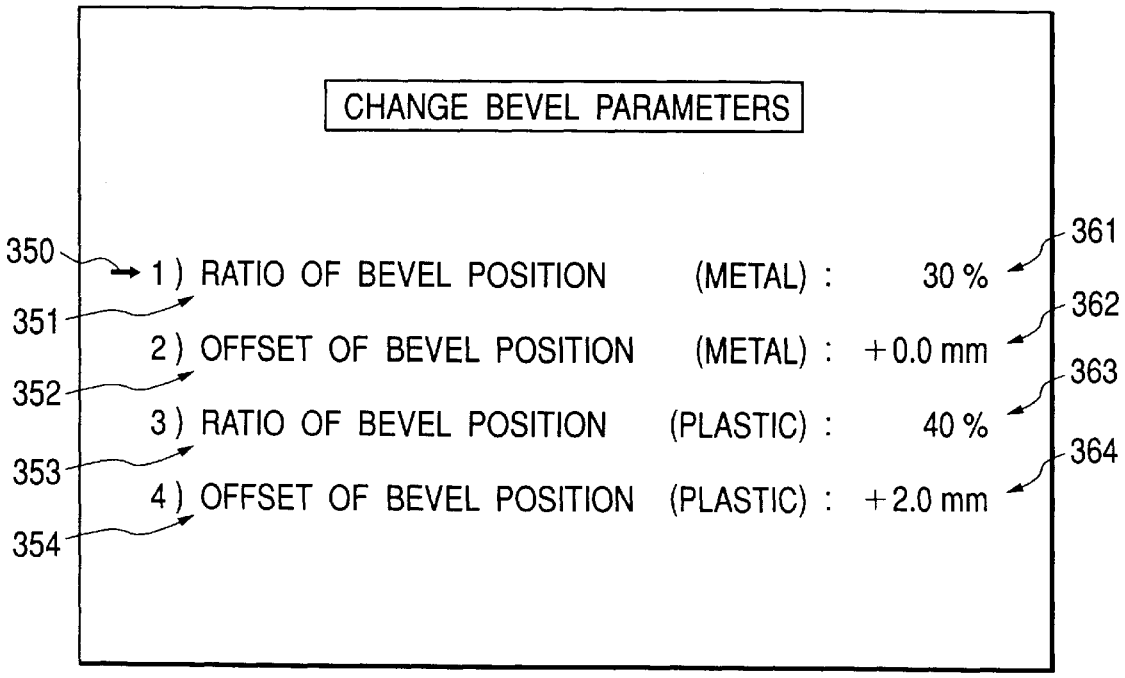
FIG. 9 is a diagram showing an exemplary image for "CHANGE BEVEL PARAMETERS".

Before starting lens processing in an auto mode, the operator may himself set parameters on the shape of a bevel to be formed on the edge of the lens to be processed. The procedure of the setting operation is as follows. Manipulate the image change switch 407 to have a menu appear on the display 3 and then select the item "ADJUST BEVEL POSITION", whereupon an image for "CHANGE BEVEL PARAMETERS" appears on the display section 3 (see FIG. 9). Four items are available to change bevel parameters and two of them apply to the case where the! eyeglass frame of interest is metallic and the other two apply to the case where it is plastic. The items available for the first case are- item 351 for entering the desired ratio by which the edge thickness along the entire periphery of the lens is to be divided in a specified layout for the position of the bevel's apex and item 352 for entering the amount of an offset by which the position of the bevel's apex, given the desired ratio of division, is translated towards either the front or rear surface of the lens. The items available for the second case are item 353 for entering the desired ratio of dividing the edge thickness of the lens as in the first case and item 354 for entering the amount of offset of the position of the bevel's apex. To select a particular item, the operator manipulates the MOVE switch 408 such that an arrow mark 350 on the left margin of the image is moved up and down. If a particular item is selected, relevant data are entered by adjusting the numerals appearing to the right of the respective CHANGE items (as indicated by 361–364) through the manipulation of switches 409*a* and 409*b*. Before adjustment, stored standard values are displayed for the respective items.

The ratio to be selected from items 351 and 353 is 0% if the position of the bevel's apex coincides with the front surface of the lens and 100% if it coincides with the rear surface of the lens. Hence, a ratio of 30% means that the position of the bevel's apex is determined such that the ratio of the front side of the edge thickness to the rear side is 3:7. Speaking of the amount of offset to be selected from items 352 and 354, entry of "+2.0 mm" means that the position of the bevel's apex given a specified ratio of division is translated 2.0 mm towards the rear surface of the lens.

Different settings of the layout of bevel position can be selected depending upon whether the constituent material of the eyeglass frame is metallic or plastic. Hence, even in processing in AUTO mode, an appropriate bevel position can be set in accordance with the constituent material of which the eyeglass frame is made. Generally speaking, metallic frames have thin rims whereas plastic frames have thick rims; therefore, in order to ensure good aesthetic appeal when lenses are fitted in an eyeglass frame, the position of the bevel's apex may be set closer to the front surface of each lens if the frame is metallic or it may be set towards the center if the frame is plastic. This can be accomplished by adjusting the amount of offset.

When the necessary changes have been entered, the CHANGE switch 410 is manipulated to return the displayed image to a menu, whereupon the standard values in the program for bevel calculations are rewritten and stored.

We then describe the actual processing operation. In the first place, an eyeglass frame (or a template therefor) is set on the eyeglass frame and template configuration measuring section 2 and the tracing switch 416 is touched to start tracing. The radius vector information on the eyeglass frame as obtained by the functional part 2*a* is stored in a trace data memory 202. when the next data switch 417 is touched, the data obtained by tracing is transferred into the machine and stored in the data memory 103. At the same time, graphics in the form of a frame is presented on the screen of the display section 3 on the basis of the eyeglass frame data, rendering the machine ready for the entry of processing conditions.

In the next step, the operator who is looking at the screen of the display section 3 operates on the input section 4 to enter layout data such as the PD, the FPD and the height of the optical center. The apparatus is supplied with new radius vector information ($r_s\delta_n$, $r_s\theta_n$) based on the radius vector information for the eyeglass frame and the entered layout data.

Subsequently, the operator determines what the lens to be processed and the frame are made of and as to whether the lens is for use on the right or left eye and enters the necessary data. In addition, the operator touches the MODE switch 404 to select the AUTO processing mode. After entering the processing conditions, the lens to be processed is subjected to specified preliminary operations (e.g., centering of the suction cup) and chucked between the lens rotating shafts 704*a* and 704*b*. Then, the START/STOP switch 411 is touched to activate the machine.

In response to the entry of a start signal, the machine performs arithmetic operations to effect processing correction (the correction of the radius of each abrasive wheel) on the basis of the entered data so as to yield information for the processing correction (see, for example, U.S. Pat. No. 5,347,762). Subsequently, the lens configuration measuring section 5 is activated to measure the lens configuration, thereby yielding edge position information ($lZ_n$, $rZ_n$) for the bevel's apex or shoulder for both the front and rear surfaces of the lens in association with the radius vector information. On the basis of both the edge position information and the aforementioned conditions for bevel forming ratio which are dependent on the constituent material of the eyeglass frame (metallic or plastic) as designated by manipulation of the switch 403, the position of the bevel's apex $yZ_n$ is determined by the following equation:

$$lZ_n+(rZ_n-lZ_n)R/100=yZ_n$$

where R is the ratio of dividing the edge thickness which is entered as a bevel parameter. If the amount of offset is also an input item, it is added so as to determine the position of the bevel's apex in association with the radius vector information and the thus determined position is used as bevel data. Another way to calculate the position of the bevel's apex is such that the curves of the front and rear surfaces of the lens are determined from the information on the edge position and if the curve of the front surface is within a certain range, the position of the bevel's apex is shifted from the edge position of the front surface by a certain amount towards the rear surface and a bevel curve which is the same as the curve of the front surface of the lens is established (see, for example, U.S. Pat. No. 5,347,762).

In the AUTO processing mode, rough grinding is started in response to the entry of a START signal. The machine moves the chucked lens to the rough abrasive wheel specified in accordance with the designated constituent material of the lens to be processed and subsequently the machine controls the drive of the associated motors based on the information for processing correction such as to perform the processing of the lens. During this rough grinding operation, bevel sections based on the bevel data determined by bevel calculations are automatically displayed in succession on the display section 3 to cover the entire periphery of the lens and this helps the operator check for the correctness of the bevelling operation.

After the end of the rough grinding operation, the process then goes to the finishing operation. The machine disengages the lens from the rough abrasive wheel, replaces it into the bevel processing groove on the finishing abrasive wheel 60*c* and controls the drive of the associated motors based on the bevelling information so as to form the desired bevel.

As described above, the operator, even if he is performing AUTO processing, can set the layout for the position of the bevel's apex in advance and, hence, is capable of forming a bevel that complies with the specifications he desires. In addition, the bevel forming operation can be set specifically in accordance with the constituent material of the eyeglass frame and, hence, automated processing can be performed by means of materials designation, in a manner that is appropriate to the designated material.

In a forced processing mode, bevel data calculated with altered parameters are displayed on the display section 3 (for bevel simulation) and switches in the input section 4 are manipulated to make further changes in the displayed bevel data, thereby ensuring efficient formation of a bevel that complies with the specifications the operator desires.

The foregoing description assumes that bevel formation is performed on the basis of a preset desired ratio of dividing the edge thickness. In practice, however, the edge thickness of the lens to be processed varies with its power, so the ratio of dividing the edge thickness may be adapted to be variable in accordance with the lens power which is either entered as input data or calculated by mathematical operations (the lens power is determined by the refractive index of the lens material and the curves of its front and rear surfaces but, alternatively, it may be based on the curves of the front and rear surfaces of the lens as determined from the information on the edge position). The ratio of dividing the edge thickness may be varied linearly over a specified range of lens power or it may be varied stepwise; if desired, the two ways of variation may be combined. With an eyeglass lens of a positive power having a steep curve on the front surface, the ratio is preferably set at about 50% because the bevel curve can be rendered gentle enough to provide a good fit into the eyeglass frame. When setting bevel parameters for performing the above-described method of bevel formation in AUTO processing mode, particularly good convenience is achieved by entering the point of variation and designating the ratios before and after the variation.

It is also within the scope of the invention to vary the amount of offset in accordance with a minimum edge thickness that is derived from the lens power and the information on the edge position. The setting of bevel parameters may be such that the operator has various options to choose that comprise preset parametric combinations.

As described on the foregoing pages, the apparatus of the invention enables the operator to set the conditions for bevel formation easily even in the AUTO mode and, hence, a bevel that complies with the specification the operator desires can be formed efficiently.

In addition, different bevels can be formed in accordance with what constituent material the eyeglass frame is made of and this allows for efficient formation of a bevel that provides good aesthetic appeal when the processed lenses and fitted into the eyeglass frame.

What is claimed is:

1. An eyeglass lens grinding apparatus for grinding, including bevel processing so as to produce a bevel having an apex on a periphery of a lens to fit into an eyeglass frame, comprising:

frame data inputting means for entering configuration data on said eyeglass frame;

layout data inputting means for entering layout data to be used in providing a layout of the lens corresponding to said eyeglass frame;

edge position detecting means for detecting an edge position, on each of a front and a rear surface of the lens as expected after completion of bevel processing, on the basis of said frame configuration data and said layout data whereby an edge thickness, as measured between the front and rear surfaces of the lens at the lens periphery, can be determined;

selecting means which selects between an auto-bevel processing mode and a forced-bevel processing mode;

arithmetic means, which has at least one parameter that can be set by a processor, for calculating bevel position data, including a position of the bevel's apex along the edge thickness, for auto-bevel processing on a basis of data obtained by the edge position detecting means and on a basis of said at least one parameter;

parameter input means, which has a display for displaying an input screen and a screen input means, for allowing a processor to input said at least one parameter in the auto-bevel processing mode;

a storage element which stores the processor-input parameter; and control means for causing said arithmetic means to calculate bevel position data, including a position of the bevel's apex along the edge thickness, on the basis of the processor-input parameter, when the auto-bevel processing mode is selected.

2. The eyeglass lens grinding apparatus according to claim 1, wherein said at least one parameter comprises either the ratio of the edge thickness in front of the bevel apex position to the edge thickness to the rear of the bevel apex position of the processed lens or the amount of offset or both.

3. The eyeglass lens grinding apparatus according to claim 2, which further includes frame material designating means and wherein said ratio or amount of offset varies with the constituent material of the eyeglass frame.

4. The eyeglass lens grinding apparatus according to claim 3, wherein the constituent material of the eyeglass frame is either metallic or plastic.

5. The eyeglass lens grinding apparatus according to claim 1, wherein said at least one parameter is the ratio of the edge thickness in front of the bevel apex position to the edge thickness to the rear of the bevel apex position of the processed lens, and the arithmetic means calculates the bevel position data in the auto-bevel processing mode based further on the power of the lens as a variable.

6. The eyeglass lens grinding apparatus according to claim 1, which further includes curve calculating means for calculating a front surface curve of the lens, and a rear surface curve of the lens, on a basis of a result of detection by said edge position detecting means, said at least one parameter is a ratio of the edge thickness in front of the bevel apex position to the edge thickness to the rear of the bevel apex position of the processed lens, and the arithmetic means calculates the bevel position data in the auto-bevel processing mode further based on the difference between the front and rear surface curves of the lens.

7. An eyeglass lens grinding apparatus for grinding, including bevel processing so as to produce a bevel on a periphery of a lens to fit into an eyeglass frame, comprising:

frame data inputting means for entering configuration data on said eyeglass frame;

layout data inputting means for entering layout data to be used in providing a layout of the lens corresponding to said eyeglass frame;

edge position detecting means for detecting an edge position, on each of a front and a rear surface of the lens as expected after completion of bevel processing, on a basis of said frame configuration data and said layout data;

selecting means for selecting between an auto-bevel processing mode and a forced-bevel processing mode;

arithmetic means, which has at least one standard parameter that can be altered by a processor, for calculating bevel position data in the auto-bevel processing mode on the basis of data obtained by the edge position detecting means and on a basis of said at least one standard parameter that can be altered;

parameter input means, which has a display for displaying an input screen and a screen input means, for allowing a processor to alter said at least one standard parameter in the auto-bevel processing mode thereby obtaining an altered parameter;

a storage element which stores the altered parameter; and control means for causing said arithmetic means to calculate bevel position data on a basis of the altered parameter, when the auto-bevel processing mode is selected.

8. The eyeglass lens grinding apparatus according to claim 7, further comprising forced-bevel processing data input means for, when the forced-bevel processing mode is selected, further altering a portion of the bevel position data calculated using the altered parameter in the auto-bevel processing mode.

* * * * *